US005540622A

United States Patent [19]

Gold et al.

[11] Patent Number: 5,540,622

[45] Date of Patent: Jul. 30, 1996

[54] WATER SLIDE

[75] Inventors: Mark R. Gold, Los Angeles; Mark W. Sumner, Valencia, both of Calif.

[73] Assignee: The Walt Disney Company, Burbank, Calif.

[21] Appl. No.: 312,407

[22] Filed: Sep. 26, 1994

[51] Int. Cl.[6] ..... A63G 21/18

[52] U.S. Cl. ..... 472/117; 472/88

[58] Field of Search ..... 472/117, 88, 128; 104/69, 70

[56] References Cited

U.S. PATENT DOCUMENTS

| | | | |
|---|---|---|---|
| 695,444 | 3/1902 | Carson et al. | 104/70 |
| 1,441,126 | 1/1923 | Sherman et al. | 104/70 |
| 1,829,287 | 10/1931 | Lovett | 401/204 |
| 2,174,716 | 10/1939 | Bethell | 272/56.5 R |
| 2,254,482 | 9/1941 | Heller | 272/56.5 R |
| 2,742,288 | 4/1956 | Brunel | 272/56.5 R |
| 2,904,809 | 9/1959 | Clayson | 401/203 X |
| 2,918,183 | 12/1959 | Peterson et al. | 180/125 MM |
| 2,982,547 | 5/1961 | Carrier | 272/56.5 R |
| 3,406,617 | 10/1968 | Randazzo | 272/56.5 SS |
| 3,497,211 | 2/1970 | Nagin | 272/56.5 SS |
| 3,547,749 | 12/1970 | White et al. | 272/56.5 SS X |
| 3,690,265 | 9/1972 | Horibata | 104/70 |
| 3,778,054 | 12/1973 | Esposito, Jr. | 272/85 |
| 3,830,492 | 8/1974 | Deveau et al. | 272/56.5 R |
| 3,915,450 | 10/1975 | Flewwelling et al. | 272/1 B |
| 3,942,202 | 3/1976 | Chevrolet | 5/469 X |
| 3,981,546 | 9/1976 | Sperman | 180/125 X |
| 4,078,792 | 3/1978 | Arato | 5/461 X |
| 4,145,042 | 3/1979 | Becker et al. | 272/56.5 R |
| 4,196,900 | 4/1980 | Becker et al. | 272/56.5 R |
| 4,275,713 | 6/1981 | Tellander et al. | 128/66 |
| 4,339,122 | 7/1982 | Croul | 272/56.5 R |
| 4,391,201 | 7/1983 | Bailey | 104/70 |
| 4,394,173 | 7/1983 | Aste | 104/69 |
| 4,484,739 | 11/1984 | Kreinbihl et al. | 472/117 X |
| 4,910,814 | 3/1990 | Weiner | 448/8 |
| 4,971,314 | 11/1990 | Barber | 104/69 X |

*Primary Examiner*—Kien T. Nguyen
*Attorney, Agent, or Firm*—Medlen & Carroll

[57] ABSTRACT

The present invention provides a water slide which includes a device for reducing the impact felt by riders or users when they contact the slower-moving water at the bottom of an incline. Such slower moving water can be particularly injurious to a user who is traveling at relatively high speed (e.g., down a particularly long or steep slope). The device for reducing impact is a section of slide of predetermined length which includes air injection nozzles for reducing the apparent density and viscosity and increasing compressibility of the water to enable the user to slow down more gradually by transitioning from reduced density water to normal density water.

25 Claims, 4 Drawing Sheets

WATER SLIDE

FIELD OF THE INVENTION

The present invention relates to the field of recreational water slides; more particularly, the present invention relates to water lubricated speed slides.

BACKGROUND OF THE INVENTION

Recreational water slides are inclined chutes or flumes lubricated with a flowing water film which descend from an elevated entry zone along either a straight path (a speed slide) or a meandering path (a serpentine slide) to an exit section. The exit section of the slide typically includes a substantially level run out section to decelerate and stop the rider before the end of the slide. A serpentine slide may also include a splash pool. The exit section is provided so that the rider is not injured upon leaving the end of the slide. The length of the exit section varies depending on the nature of the slide and the speed likely to be imparted to the riders. As noted in U.S. Pat. No. 4,910,814 to Weiner, a minimum of 10 feet is typical for slow speed exit flumes, and lengths of 50 feet or more are typical for speed slides to ensure that the rider comes to a complete stop before the end of the slide is reached.

A rider typically enters the slide through the entry zone at the top and is accelerated by the force of gravity down the chute. The speed of the rider varies according to the height of the slide, the relative angle of inclination of the chute, and the mass (weight) of the rider. Friction does not substantially affect the speed of the rider, since the slide surface is lubricated by flowing water. The rider is decelerated and stopped by entering the water which has built up in the exit section.

With speed slides in particular, the size of the slide is affected by a number of design constraints. First, because theme parks are often located on relatively valuable real estate, and because theme park operators wish to maximize the number of rides in order to attract customers, the "footprint" of the ride—the actual area occupied by the ride—must be taken into account. In the case of speed slides, the footprint can theoretically be reduced by increasing the angle of the slide. However, increasing the angle increases the speed of the rider, which dictates an increase in the length of the run out section. Thus, any room saved by increasing the angle of the slide is consumed by providing adequate room for safe deceleration of the rider.

Second, the height (the distance from the top of the slide to the ground) of speed slides has hitherto been limited to a maximum of no more than about 80 feet so that riders do not develop so much speed that they are injured when they impact the water at the end of the slide. The height limitation cannot be overcome by providing a longer runout section for deceleration. When the water traveling down the inclined chute enters the level run out section, the velocity of the water slows appreciably, causing the water to "pile up." Thus, a rider who is moving too fast can be injured upon entering the runout section by contacting the slower-moving water. This height limitation effectively prevents riders from experiencing the exceptional thrill which comes from travelling down a water slide at higher speeds than have hitherto been possible.

Accordingly, the need exists for a water slide which can effectively decelerate a rider and, at the same time, substantially reduce the impact experienced in the run out section. Such a water slide could be made taller than any slide heretofore constructed, and/or at steeper angles than heretofore possible, for imparting a greater thrill through higher speed without substantially increasing either the footprint of the ride or the likelihood of injury.

SUMMARY OF THE INVENTION

The present invention provides a water slide capable of accelerating users to speeds which were hitherto not safely achievable by providing a braking section following the gradual transition in the slide from inclined to almost horizontal. The braking section is provided with a plurality of air nozzles which inject air into the water flowing down the slide, decreasing the apparent density and viscosity and increasing compressibility of the water at the location where the water speed slows noticeably, causing the water to "pile up." By decreasing the apparent density and viscosity and increasing compressibility of the water at this location, a user traveling at a relatively high speed will not be injured upon contacting the water at this location.

In one embodiment, the present invention provides an improved speed slide which can be constructed higher and at a steeper angle than any other speed slide known at the present time. This improved speed slide includes an inclined chute descending from an elevated entry zone. A flow of water sufficient to lubricate the slide to avoid the affects of friction between the user's skin/clothing and the sliding surface is provided. The inclined chute terminates in a transitional, relatively large radius chute, which gradually transitions the user from a steep incline to an almost horizontal chute. The transitional chute terminates in the braking section which includes a plurality of air nozzles for injecting air into the water flowing across them to decrease the apparent density and compressibility of the water. The braking section leads to a conventional runout.

In another embodiment, the present invention involves an improved speed slide as discussed above, in which the braking section is divided into multiple sections which transition the user from significantly reduced apparent water density to normal water density.

In yet another embodiment, the present invention involves a braking chute which can be used with any water slide or flume for reducing the impact felt by the user at the bottom of an incline.

Other and further embodiments may become apparent upon examination of the drawings and the following specification.

BRIEF DESCRIPTION OF THE DRAWINGS

The objects, features and advantages of the present invention will become apparent to one skilled in the art from reading the following detailed description in which.

DETAILED DESCRIPTION OF THE INVENTION

Figure 1:
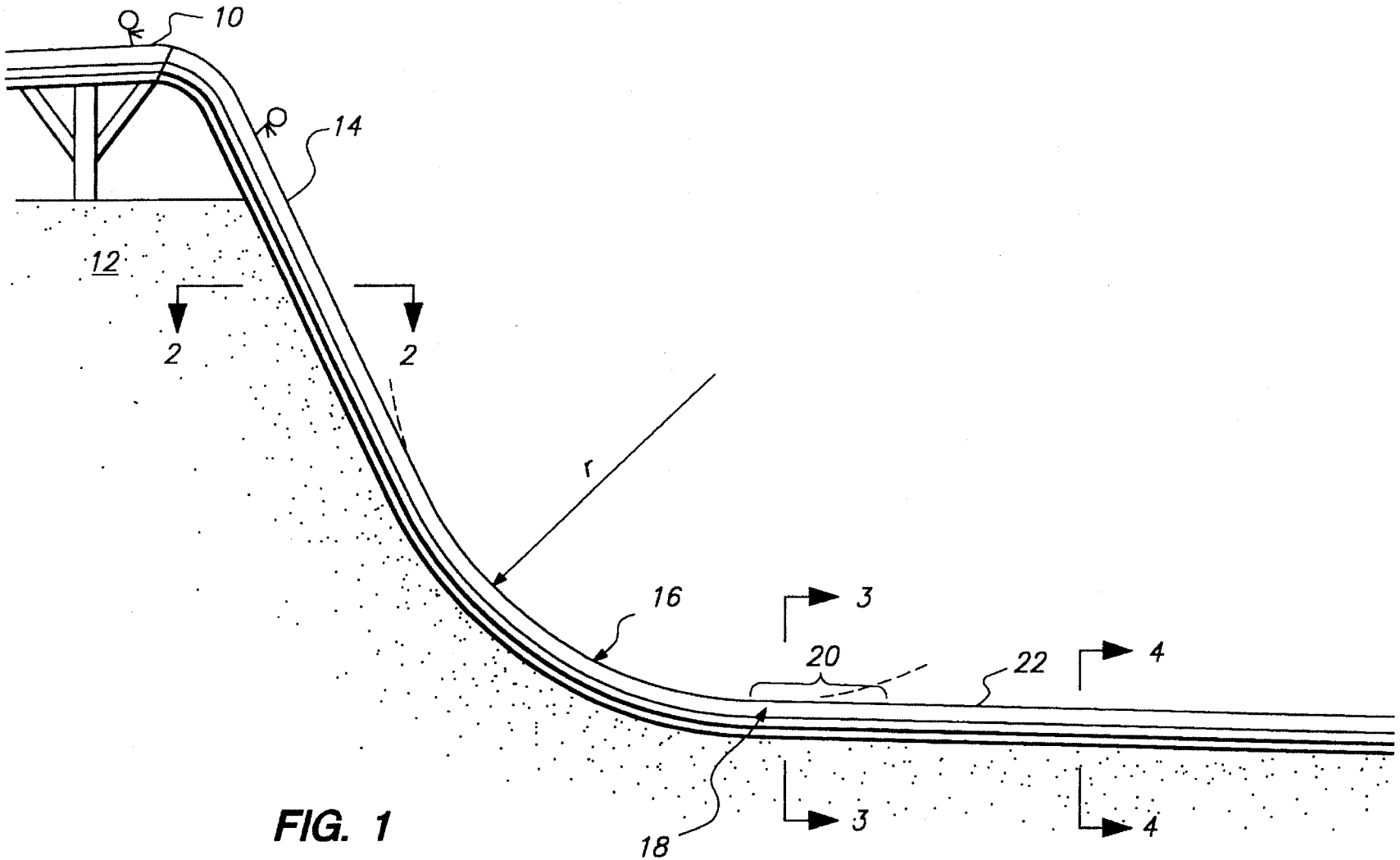
FIG. 1 provides a side view of a slide of the present invention.

As shown in FIG. 1, a slide of the present invention includes a conventional elevated entry zone 10 supported on or above a slide support structure 12. The elevated entry zone 10 is preferably constructed from commercially available components such as, for example, the Max Track fiberglass high volume start pool manufactured by ProSlide Technology, Inc. The start pool most preferably includes a plurality of water outlets for providing a flow of water down the slide. The Max Track high volume start pool, for example, includes four ½ inch diameter water outlets in the rear and two outlets in the front with irregular holes. This provides a water flow of about 1000 gallons per minute down the slide.

The slide support structure 12 can include one or more conventional structures such as steel towers, columns, concrete, or earth. Preferably, for improved safety and support, a significant portion of the inclined chute 14 can be built onto an earthen "mountain." The slide support structure 12 will also preferably include one or more conventional means, such as pathways, elevators, trams, steps, ladders or moving sidewalks, to enable the users to gain access to the elevated entry zone 10.

The transition from the entry zone 10 to the inclined chute 14 can be provided using a convex chute section of any suitable material such as, for example, fiberglass. The inclined chute 14, shown in cross-sectional view in FIG. 2, preferably includes a circular cross-sectional sliding surface 26 with relatively high walls for safety. In the preferred embodiment, the inclined chute 14 is provided with an interior radius of at least 16 inches. As with all sections of the slide, the sliding surface 26 is finished to provide a substantially smooth, substantially continuous and discrepancy-free surface to avoid injury to the rapidly moving user's limbs, posterior, and exposed skin. For a speed slide, the inclined chute 14 is substantially straight and supported by the slide support structure 12 at a relatively steep slope. With a speed slide constructed according to the present invention, that slope can be as much as 60–70 degrees from horizontal. Preferably, to provide an acceptable margin of safety while imparting a thrill not hitherto possible, the inclined chute 14 is supported at an angle of about 60 degrees from the horizontal. The length of the inclined chute 14 can be selected to correspondingly increase or limit thrill.

Figure 2:
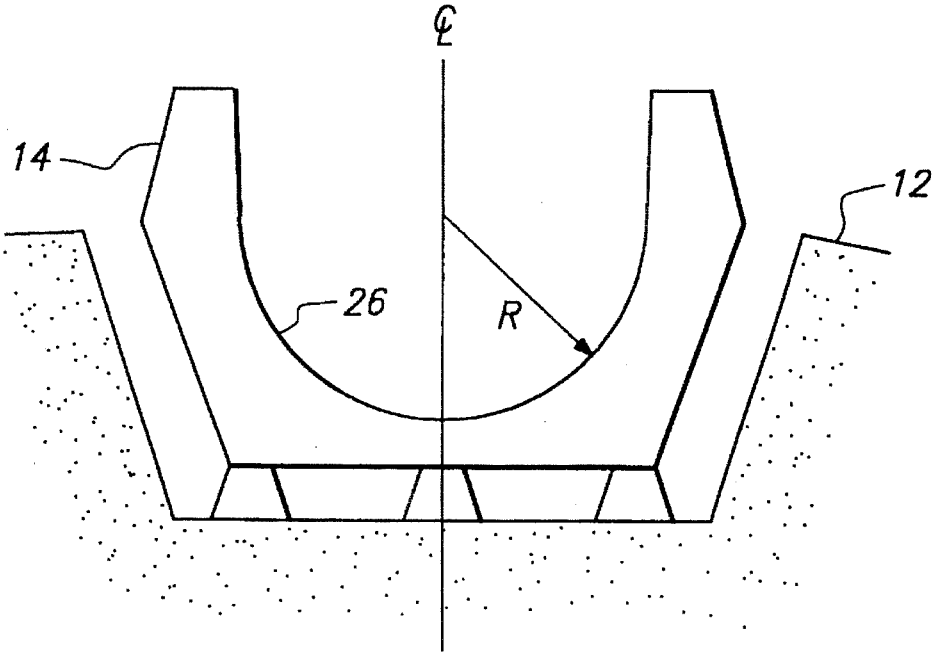
FIG. 2 provides a cross-sectional view of a chute section taken along 2—2.

As shown in FIG. 1, the inclined chute 14 terminates in a generally concave transitional chute 16 preferably having a cross-sectional shape as shown in FIG. 2. The sliding surface 26 in the concave transitional chute 16 transitions from a relatively steep slope to a substantially horizontal surface, converting the vertical momentum of the rider to horizontal motion along the slide. Preferably the radius of the concave transitional chute 16 is relatively large.

At the end of the concave transitional chute 16, the water flowing down the slide will encounter slower moving water in the horizontal sections of the slide. A few feet beyond the tangent point, the water slows noticeably. The point where this occurs is referred to as the "hydraulic jump." The position of the hydraulic jump 18 can be adjusted by changing the flow of water down the slide: increasing the flow moves the hydraulic jump 18 towards the inclined chute 14 while decreasing the flow moves the hydraulic jump 18 towards the downhill end of the slide.

Figure 3:
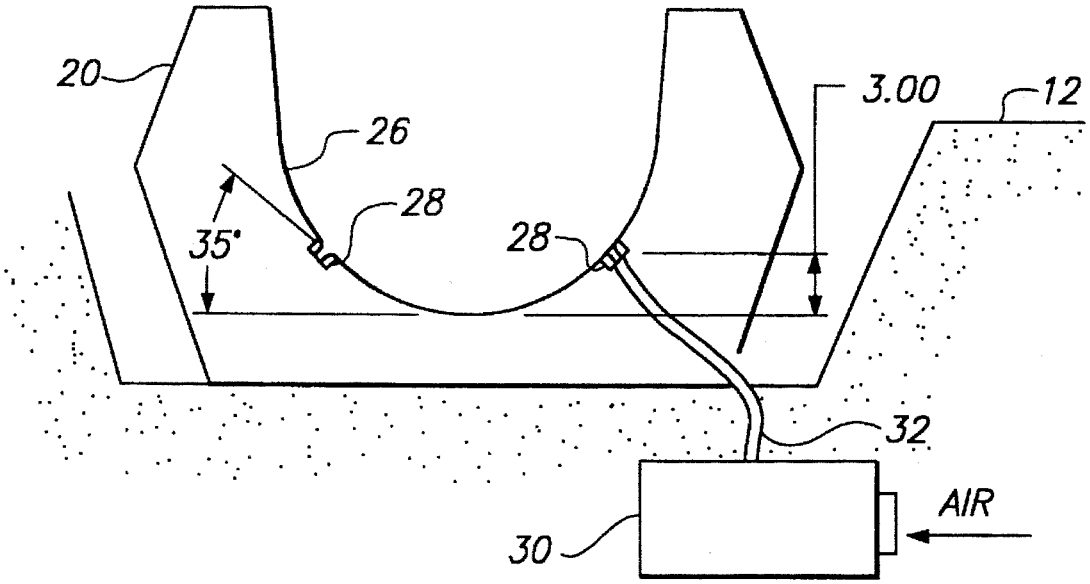
FIG. 3 provides a partially broken away, cross-sectional view of a chute section taken along 3—3.

The braking chute 20, into which the concave transitional chute 16 terminates, is located so as to contain the hydraulic jump 18. The braking chute 20 is provided with a plurality of air injection nozzles 28 along a chute section having a circular cross-section as shown in FIG. 3. The air injection nozzles 28 are preferably constructed as a separate component from any suitable material, including metals or plastics, flush mounted against the sliding surface 26 to prevent injury to users. Alternatively, the nozzles 28 could comprise small openings through the wall of the riding surface supplied with air via a plenum located behind the sliding surface 26.

Figure 5:
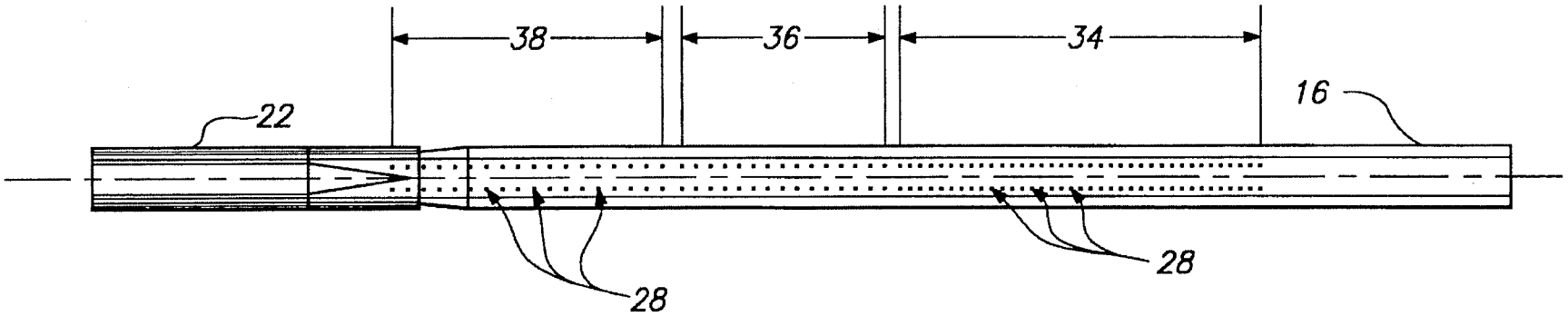
FIG. 5 provides a top view of an air injection zone of a slide of the present invention; and, FIG. 6 provides a cross-sectional top view of an air injection zone of the present invention illustrating the preferred orientation of the air nozzles relative to the direction of water flow.

As shown in more detail in FIG. 5, air injection nozzles 28 are preferably provided along both sides of the braking chute 20, and are most preferably mounted in a staggered, rather than an aligned, orientation. Air injection nozzles could also be provided additionally or alternatively along the bottom of the sliding surface 26.

Figure 6:
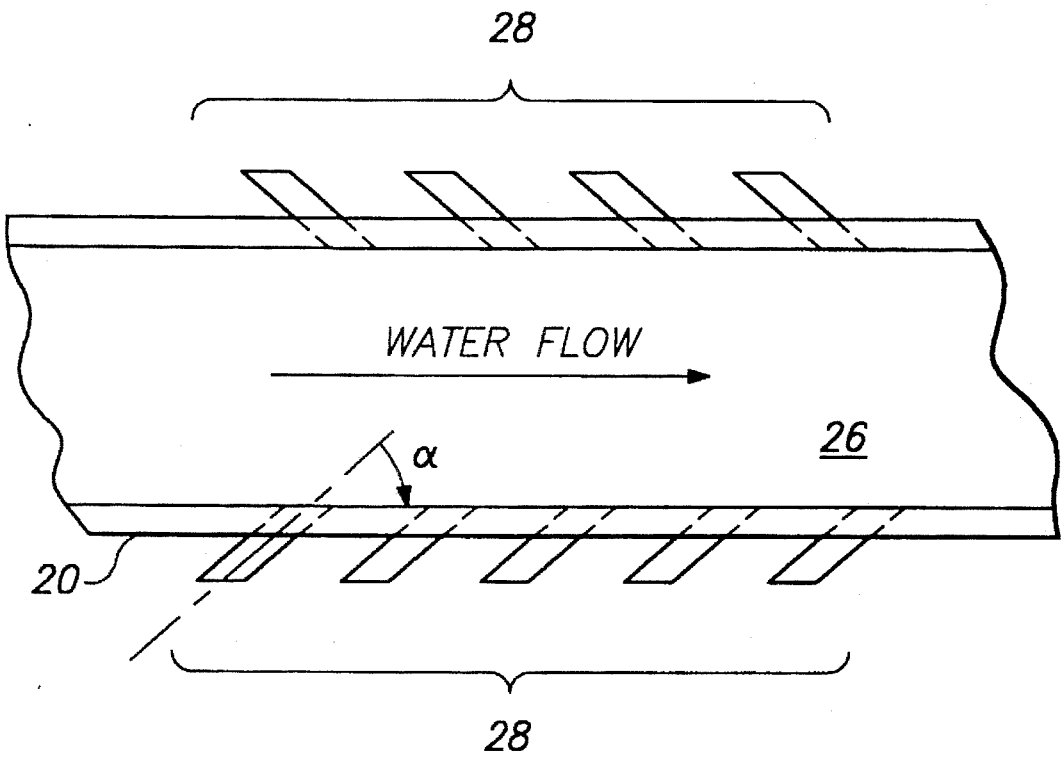

As shown in FIG. 6, air injection nozzles 28 are preferably mounted at an angle to direct the air in the direction of water flow. Most preferably, the angle formed between a longitudinal axis located in the center of the air stream of the nozzle and the downstream wall of the braking chute 20, identified in FIG. 6 as $\alpha$, is about 45 degrees. This allows the air to add some energy (velocity) to the water, enabling the slide operator to move the hydraulic jump further downstream than it normally would be by increasing the air flow through the nozzles. (Prior to this invention, the hydraulic jump could be moved by varying the water flow rate, chute cross-section, or vertical profile). Moving the hydraulic jump downstream enables the riders to obtain additional deceleration before coming into contact with the water build-up at the hydraulic jump.

Air is provided to the air injection nozzles 28 by conventional means such as an air compressor 30 which is connected to air injection nozzles 28 via an air line 32. While the slide is in use, air is continuously pumped through the air injection nozzles 28 to reduce the apparent density and viscosity, and increase the compressibility of the moving water at the hydraulic jump and beyond. The length of the braking chute can be selected to effectively reduce the speed of the user so that injury does not occur when the run out section 22 is encountered. Most preferably, to achieve this end, the braking chute 20 is divided into at least three zones 34, 36, and 38 with different spacing. The closest spacing between nozzles is found in zone 34, and will provide a maximum reduction in apparent density of the water flowing over the sliding surface. A somewhat wider spacing is provided in zone 36, with a corresponding increase in apparent water density. A somewhat wider spacing still is provided in zone 38, with a further corresponding increase in density. At the end of zone 38, in the runout section, the water density is normal. By providing such zones, the user of the slide is decelerated through zones of reduced, but gradually increasing apparent water density until the user is transitioned to normal water density. Thus, the user can be effectively decelerated from higher speeds than has hitherto been experienced without injury or discomfort resulting from impacting the slow-moving water at the bottom of the slide. The air flow rate for each zone 34, 36, 38 can be selected to further vary the density of the water in each zone.

Figure 4:
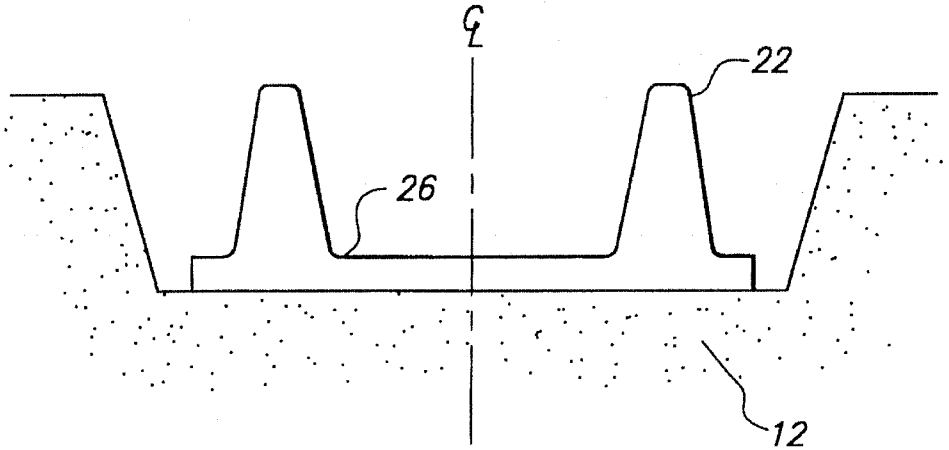
FIG. 4 provides a cross-sectional view of a chute section taken along 4—4.

The substantially straight run out section 22, shown in FIGS. 1 and 4, can be provided with a substantially rectangular cross-section to increase the drag between the user and the sliding surface 26, to further decelerate the user. The length of the run out section 22 can be selected depending on what the user is intended to experience. Preferably, the run out section 22 is sufficiently long so that the user comes to a stop well short of the end of the run out section, and simply stands up and climbs out of the slide. The end of the run out section 22 may include conventional water handling equipment, such as a recirculating water sump and/or water level controlling equipment (not shown).

The entire slide, as described above, can be constructed in one piece using conventional techniques using, for example, fiberglass. More preferably, conventional, modified conventional, or custom track sections are bolted together, and to the underlying support structure, to form the slide.

To use a slide of the present invention, a user employs the means for accessing the slide entry zone 10 which is located on the slide support structure 12. The user sits on the sliding surface 26 at the entry zone and is propelled by the flowing water over a convex chute section and onto the inclined chute 14. The speed of the user increases at a rapid rate with travel down the inclined chute 14 as a result of acceleration due to gravity. The user's acceleration decreases between the beginning and the end of the transitional zone 16. When the user encounters the braking chute 20, no discomfort is encountered, and the user decelerates to a speed which is low enough so that no discomfort is encountered upon leaving the braking chute 20—with its reduced density water—and entering the run out section 22 with its ordinary density water. Significant further deceleration occurs in the run out section 22, until the user's forward momentum finally stops, when the user can leave the run out section 22 and return to the entry zone 10 if another ride is desired.

While the description above has been primarily directed to a speed slide construction, one skilled in the art will recognize that it can be modified and used with a variety of water slides, including serpentine slides. The following is an example of a slide of the present invention which could be constructed:

EXAMPLE

A speed slide of the present invention has been engineered and will be built using the following. An earthen "mountain" will be constructed to form a base for much of the support structure and to conform the slide to the theme of the park. A steel tower (approximately 31.36 feet high) will be constructed on top of the "mountain" to support the entry zone and the upper portion of the inclined chute.

The slide entry zone is constructed using ProSlide Technology Inc's MAXTRACK™ high volume start pool. This start pool includes 4 rear water outlets having a ½ inch diameter, and 2 front water outlets (one on each side of the sliding surface) with irregular openings for the egress of water. These outlets provide a flow of water down the slide of approximately 1000 USGPM.

The start pool is connected at the outlet side to one end of a MAXTRACK™ custom convex section which provides a drop of 2.27 feet and a run of almost 2 feet. Like all the sections described hereafter, the MAXTRACK™ sections selected for use in constructing this slide provide a sliding surface which is about 31 inches from wall to wall. Connected to the other end of the custom convex section is a MAXTRACK™ custom straight section which provides a drop of 3 feet and a run of 1 foot.

The inclined section of the slide is formed from 4 MAXTRACK™ double straight sections, each of which are 15 feet long. These are bolted together end to end, and bolted at the uphill side of the first to the downhill end of the custom straight section. They are also bolted to the support structure. This inclined section forms a drop of 52.12 feet (from the downhill end of the custom straight section to the downhill end of the last inclined section) and a run of about 29.78 feet.

Beginning at the downhill end of the last double straight section is bolted the first of 12 MAXTRACK™ 125 foot radius concave sections. These are bolted together end to end, as well as bolted to the support structure. This section forms a drop of about 62.95 feet from the downhill end of the last inclined section to the downhill end of the last concave section.

Beginning at the downhill end of the last concave section is bolted the first of 4 MAXTRACK™ double straight sections which have been modified by mounting in them nozzles for injecting air in the stream of water passing over the sliding surface when the slide is operational. The nozzles are arranged to provide three distinct air injection zones substantially as shown in FIG. 5, with the individual air nozzles oriented downstream at 45 degrees to the downstream portion of the braking section wall, substantially as shown in FIG. 6. The first zone comprises a portion of the first double straight section and all of the second double straight section. The nozzles are mounted so that the nozzles on the right hand side (looking from the end of the last concave section towards the double straight sections) are not aligned with, but are staggered with, the nozzles mounted on the right side. The position of the nozzles relative to the bottom of the slide is substantially as shown in FIG. 3.

The first nozzle uphill in the first double straight braking section is on the right and is spaced 72 inches from the downhill end of the last concave section. The first uphill nozzle on the left is spaced 76 inches from the downhill end of the last concave section. There are a total of 14 nozzles mounted on the right, each of which are spaced 8.0 inches on center from each adjacent nozzle on the right. There are 13 nozzles on the left, each of which are spaced 8.0 inches on center from each adjacent nozzle on the left.

The second double straight braking section has 22 nozzles on the right and 23 nozzles on the left, which continue the 8.0 inch o.c. spacing described above.

The third double straight braking section has 2 nozzles mounted on the right of the uphill end and 1 nozzle mounted on the left of the uphill end which continue the 8.0 spacing. Downhill from these nozzles is a space of 12 inches on the right and 10 inches on the left, to the center of the next nozzle on each side. This space marks the transition from the first air injection zone to the second air injection zone, characterized by a 12.0 inch o.c. spacing between nozzles on each side. There are 14 nozzles on the right and 14 nozzles on the left.

The fourth double straight braking section has one nozzle on the uphill end on both the right and the left which are spaced 12.0 inch o.c. from the nearest nozzle on each respective side of the downhill end of the third double straight braking section. Following this first nozzle, there is a space on the right of 14 inches and on the left of 13 inches to the next nozzle, this space marking the transition to the third air injection zone, characterized by a 14.0 inch o.c. spacing between nozzles. There are 12 nozzles on the right and 12 nozzles on the left which have this 14.0 inch o.c. spacing.

The downhill end of this fourth double straight braking section is joined to a MAXTRACK™ runout transition section, which is provided with 2 air nozzles on the right and 2 air nozzles on the left, spaced 14.0 inch o.c. with the last air nozzle on each respective side on the downhill end of the fourth double straight braking section.

The downhill end of the runout transition section is joined to 7 MAXTRACK™ standard runout sections. These runout sections are connected end to end and bolted to the underlying support structure. The downhill end of the last runout section is joined to a MAXTRACK™ endcap overflow section. This section includes a sump which recirculates the water flowing down the slide.

The invention has been described in terms of the preferred embodiment. One skilled in the art will recognize that it would be possible to construct the elements of the present invention from a variety of materials and to modify the placement of the components in a variety of ways. While the preferred embodiments have been described in detail and shown in the accompanying drawings, it will be evident that various further modifications are possible without departing from the scope of the invention as set forth in the following claims.

What is claimed is:

1. A water slide comprising:

an entry zone elevated more than about 80 feet above ground level;

an inclined, substantially continuous sliding surface having an uphill end connected to the elevated entry zone and a downhill end extending away from said entry zone, said inclined sliding surface having a slope forming an acute angle with horizontal of at least about 60 degrees;

a relatively level sliding surface having an uphill end continuous with the downhill end of the inclined sliding surface and a downhill end extending away from said inclined sliding surface, said level sliding surface having sufficient length decelerate a user; and, a means for creating a flow of water over the inclined sliding surface and the level sliding surface;

said level sliding surface including a means for injecting air into the flow of water passing over it, whereby a reduction of apparent density of said water will occur.

2. The slide of claim 1 wherein said means for injecting air comprises a plurality of air nozzles, each of which has an aperture for the passage of air, said air nozzles mounted in said level sliding surface a predetermined distance from the downhill end of the inclined sliding surface and extending for a predetermined distance towards the downhill end of the level sliding surface, along with an air compressor means and conduit means for conveying air generated by said air compressor means to each said nozzle.

3. The slide of claim 2 wherein some of said air nozzles are located to the right of a longitudinal center axis of said level sliding surface, and the remaining air nozzles are located to the left of the longitudinal center axis.

4. The slide of claim 3 wherein some of said air nozzles are aligned along a longitudinal axis parallel with and to the right of said longitudinal center axis and the remaining air nozzles are aligned along a longitudinal axis parallel with and to the left of the longitudinal center axis.

5. The slide of claim 3 wherein none of the air nozzles mounted to the right of the longitudinal center axis are aligned on an axis perpendicular to the longitudinal center axis with any of the air nozzles mounted to the left of the longitudinal center axis.

6. The slide of claim 3 wherein said level sliding surface comprises at least a first zone, located a predetermined distance from the downhill end of the inclined sliding surface, and a second zone, located a predetermined distance in the downhill direction from a downhill end of the first zone.

7. The slide of claim 6 wherein each nozzle to the right of the longitudinal center axis in said first zone is spaced a first distance on center from each adjacent nozzle, and each nozzle to the left of the longitudinal center axis in said first zone is spaced a second distance on center from each adjacent nozzle, and each nozzle to the right of the longitudinal center axis in said second zone is spaced a third distance on center from each adjacent nozzle, and each nozzle to the left of the longitudinal center axis in said second zone is spaced a fourth distance on center from each adjacent nozzle.

8. The slide of claim 7 wherein said first and second distances are the same, and wherein said third and fourth distances are the same, and wherein said first and second distances are smaller than said third and fourth distances.

9. The slide of claim 6 additionally comprising a first means for applying a first air pressure to said nozzles in said first zone, and a second means for applying a second air pressure to said nozzles in said second zone, and wherein said first air pressure is greater than said second air pressure.

10. The slide of claim 2 wherein said nozzles are mounted to inject air into said flow of water in a downstream direction.

11. The slide of claim 10 wherein said nozzles are mounted at an angle to the flow of water whereby a central axis passing through said aperture of each said nozzle forms an angle of about 45 degrees with an axis extending from each said nozzle along the sliding surface in a downstream direction.

12. The slide of claim 11 additionally including a means for varying the air flow to the nozzles.

13. A water lubricated speed slide comprising:

an entry zone elevated more than about 80 feet above ground level;

an inclined, substantially straight and continuous sliding surface having an uphill end connected to the elevated entry zone and a downhill end extending away from said entry zone, said inclined sliding surface having a slope forming an acute angle with horizontal which is about 60 degrees or greater;

a substantially straight, relatively level sliding surface having an uphill end continuous with the downhill end of the inclined sliding surface and a downhill end extending away from said inclined sliding surface; and, a means for creating a flow of water over the inclined sliding surface and the level sliding surface;

said level sliding surface including a means for injecting air into the flow of water passing over it, whereby a reduction of apparent density of said water will occur, said level sliding surface having sufficient length when air is injected into the flow of water to decelerate a user.

14. The slide of claim 13 wherein said entry zone is located more than 90 feet above said level sliding surface.

15. The slide of claim 13 wherein said means for injecting air comprises a plurality of air nozzles, each of which is provided with an aperture for the passage of air, mounted in said level sliding surface a predetermined distance from the downhill end of the inclined sliding surface and extending for a predetermined distance towards the downhill end of the level sliding surface, along with an air compressor means and conduit means for conveying air generated by said air compressor means to each said nozzle.

16. The slide of claim 15 wherein some of said air nozzles are aligned along a longitudinal axis parallel with and to the right of a longitudinal center axis of said level sliding surface, and the remaining air nozzles are aligned along a longitudinal axis parallel with and to the left of the longitudinal center axis.

17. The slide of claim 16 wherein none of the air nozzles mounted to the right of the longitudinal center axis are aligned on an axis perpendicular to the longitudinal center axis with any of the air nozzles mounted to the left of the longitudinal center axis.

18. The slide of claim 15 wherein said nozzles are mounted at an angle to the flow of water whereby a central axis passing through said aperture of each said nozzle forms an angle of about 45 degrees with an axis extending from each said nozzle along the sliding surface in a downstream direction.

19. The slide of claim 18 additionally including a means for selectively varying the flow of air to the nozzles.

20. The slide of claim 15 wherein said level sliding surface comprises at least a first zone, located a predetermined distance from the downhill end of the inclined sliding surface, and a second zone, located a predetermined distance in the downhill direction from a downhill end of the first zone.

21. The slide of claim 20 wherein each nozzle to the right of the longitudinal center axis in said first zone is spaced a first distance on center from each adjacent nozzle, and each nozzle to the left of the longitudinal center axis in said first zone is spaced a second distance on center from each adjacent nozzle, and each nozzle to the right of the longitudinal center axis in said second zone is spaced a third distance on center from each adjacent nozzle, and each nozzle to the left of the longitudinal center axis in said second zone is spaced a fourth distance on center from each adjacent nozzle.

22. The slide of claim 21 wherein said first and second distances are the same, and wherein said third and fourth distances are the same, and wherein said first and second distances are smaller than said third and fourth distances.

23. The slide of claim 20 additionally comprising a first means for applying a first air pressure to said nozzles in said first zone, and a second means for applying a second air pressure to said nozzles in said second zone, and wherein said first air pressure is greater than said second air pressure.

24. A water slide comprising:

an elevated entry zone;

an inclined, substantially continuous sliding surface having an uphill end connect to the elevated entry zone and a downhill end extending away from said entry zone;

a relatively level sliding surface having an uphill end continuous with the downhill end of the inclined sliding surface and a downhill end extending away from said inclined sliding surface; and, a means for creating a flow of water over the inclined sliding surface and the level sliding surface;

said level sliding surface including a means for injecting air into the flow of water passing over it, whereby a reduction of apparent density of said water will occur, said means for injecting air comprising a plurality of air nozzles, some of said air nozzles located to the right of a longitudinal center axis of said level sliding surface, and the remaining air nozzles located to the left of the longitudinal center axis, each of said nozzles having an aperture for the passage of air, said air nozzles mounted in said level sliding surface a predetermined distance from the downhill end of the inclined sliding surface and extending for a predetermined distance towards the downhill end of the level sliding surface, along with an air compressor means and conduit means for conveying air generated by said air compressor means to each said nozzle.

25. A water lubricated speed slide comprising:

an elevated entry zone;

an inclined, substantially straight and continuous sliding surface having an uphill end connect to the elevated entry zone and a downhill end extending away from said entry zone;

a substantially straight, relatively level sliding surface having an uphill end continuous with the downhill end of the inclined sliding surface and a downhill end extending away from said inclined sliding surface; and, a means for creating a flow of water over the inclined sliding surface and the level sliding surface;

said level sliding surface including a means for injecting air into the flow of water passing over it, whereby a reduction of apparent density of said water will occur, said means for injecting air comprising a plurality of air nozzles, each of which is provided with an aperture for the passage of air, mounted in said level sliding surface a predetermined distance from the downhill end of the inclined sliding surface and extending for a predetermined distance towards the downhill end of the level sliding surface, along with an air compressor means and conduit means for conveying air generated by said air compressor means to each said nozzle, wherein some of said air nozzles are aligned along a longitudinal axis parallel with and to the right of a longitudinal center axis of said level sliding surface, and the remaining air nozzles are aligned along a longitudinal axis parallel with and to the left of the longitudinal center axis.

* * * * *